United States Patent [19]

Tokita et al.

[11] Patent Number: 4,652,792

[45] Date of Patent: Mar. 24, 1987

[54] COLOR CATHODE RAY TUBE WITH RESILIENT SHADOW MASK SUPPORT

[75] Inventors: Kiyoshi Tokita, Fukaya; Michio Nakamura, Saitama; Hiroshi Urata, Fukaya, all of Japan

[73] Assignee: Kabushiki Kaisha Toshiba, Kawasaki, Japan

[21] Appl. No.: 838,811

[22] Filed: Mar. 11, 1986

[30] Foreign Application Priority Data

Mar. 11, 1985 [JP] Japan ..... 60-46652
Nov. 28, 1985 [JP] Japan ..... 60-266014

[51] Int. Cl.[4] ..... H01J 29/07
[52] U.S. Cl. ..... 313/404; 313/407
[58] Field of Search ..... 313/402, 404, 407, 408

[56] References Cited

U.S. PATENT DOCUMENTS 3,529,199 9/1970 Duistermaat et al. ..... 313/404
3,808,493 4/1974 Kawamura et al. ..... 313/404
4,482,426 11/1984 Maynard et al. ..... 156/640

FOREIGN PATENT DOCUMENTS 46-4104 1/1968 Japan .
58-144 5/1977 Japan .
159166 12/1979 Japan ..... 313/404

*Primary Examiner*—David K. Moore
*Assistant Examiner*—K. Wieder
*Attorney, Agent, or Firm*—Cushman, Darby & Cushman

[57] ABSTRACT

In a color cathode ray tube, a shadow mask is stretched on a mask frame and the mask frame is supported on a peripheral inner surface of a skirt of a panel by an elastic deformable plate member. The elastic deformable plate member is formed by bending a metal plate and has a straight plate section with a predetermined analge $\alpha$ defined by the following inequality.

$$\tan(\alpha) > (\alpha m/\alpha f)\tan(90-\beta)$$

where $\beta$ is an angle formed by a tube axis and one of the electron beams which passes through effective one of apertures of the shadow mask, said one of the apertures being closest to the plate member, and $\alpha m$ and $\alpha f$ are thermal expansion coefficients of the shadow mask and mask frame, respectively.

15 Claims, 9 Drawing Figures

COLOR CATHODE RAY TUBE WITH RESILIENT SHADOW MASK SUPPORT

BACKGROUND OF THE INVENTION

The present invention relates to a color cathode ray tube and, more particularly, to a structure for supporting a shadow mask on an inner surface of a panel thereof.

As shown in FIG. 1, a conventional color cathode ray tube has a vacuum envelope comprising rectangular panel 1, funnel 2, and neck 3. Phosphor screen 4 consisting of phosphor stripes for emitting red, green, and blue light rays, upon landing of electron beams thereon, is formed on an inner surface of a faceplate of panel 1. So-called in-line electron gun assembly 6 is aligned along the horizontal axis of panel 1, and is arranged in neck 3 so as to emit three electron beams corresponding to the red, green, and blue phosphor stripes. A peripheral portion of shadow mask 5 is supported by mask frame 17. Shadow mask 5 has a large number of slit apertures aligned in the vertical direction and a large number of vertical arrays aligned in the horizontal direction. Frame 17 is fixed at positions near screen 4 through resilient support member 12.

Three in-line electron beams 14 are deflected by external deflection coil 9 located outside funnel 2 and the shadow mask 5 is scanned with the deflected beams. Electron beams 14 pass through the apertures of mask 5 and land on their corresponding phosphor stripes, thereby reproducing a color image. In order to prevent degradation of color purity in the reproduced image, caused by mislanding of electron beams on the phosphor stripes due to an external magnetic field influence such as geomagnetism, magnetic shielding plate 8 of a ferromagnetic metal is locked inside funnel 2 through frame 7.

In such a color cathode ray tube, a pitch of the slit apertures of mask 5 must be about $\frac{1}{3}$ that of the phosphor stripes. For this reason, the number of effective electron beams 14 passing through the slit apertures is normally decreased to $\frac{1}{3}$ or less. The remaining electron beams 14 bombard mask 5, often heating it to about 80° C. In particular, in special color cathode ray tubes used for display CRTs in aircraft cockpits, shadow masks are often heated to about 200° C. Mask 5 is normally made of a 0.2-mm thick thin plate which has, as a major constituent, iron with a relatively large thermal expansion coefficient. The peripheral portion of mask 5 is fixed by a 1.6-mm thick rigid mask frame 7. Electron beams 14 bombarding mask 5 heat and expand it, thus changing a gap (to be referred to as a Q value for brevity hereinafter) between screen 4 and mask 5. When a change in Q value exceeds an allowable range, electron beams 14 cannot land accurately on the phosphor stripes, thereby causing mislanding and the subsequent color purity degradation described above. In order to prevent this drawback, in a conventional color cathode ray tube described in Japanese Patent Publication No. 44-3547, mask frame is locked on a panel side wall, i.e., a skirt, through bimetal as a resilient support member. When it is heated, the entire mask is moved by bimetal toward screen 4 so as to substantially maintain the Q value within the allowable range.

However, the structure using the bimetal described above is complicated and requires a large number of components, thus varying the dimensional precision of the tube. In addition, since the principle of operation is based on a heat conduction route of the shadow mask, the mask frame and the bimetal, heat conduction is very slow and cannot provide a sufficient correction effect. As a result, the color impurity varies, and a high-quality color cathode ray tube becomes expensive.

Japanese Patent Publication No. 58-144 (Japanese Patent Disclosure No. 53-144252) describes the color cathode ray tube shown in FIG. 2. In this tube, frame 17 of shadow mask 5 is supported by frame support or hook member 12 on the inner surface of panel 1. Support 12 is elastic and deformable and has a substantially V-shaped section. This prior art also describes that electron beam mislanding caused by dooming can be prevented when an angle $\theta$ of the V-shaped frame support is half that of the deflection angle of the tube. However, in such a color cathode ray tube, as was prepared by the present inventors according to the above conditions, it was confirmed that the degradation of color purity could not be sufficiently prevented.

As shown in FIG. 3, Japanese Patent Publication No. 46-4104 describes a color cathode ray tube with substantially L-shaped resilient support member 12. A mask frame is not used and member 12 is directly connected to the peripheral edge of shadow mask 5. Support member 12 is inclined by $\theta=45°$, i.e., half of the deflection angle (90°) with respect to the peripheral edge of mask 5. Unlike the color cathode ray tube described in Japanese Patent Publication No. 58-144, heat can be directly conducted from the shadow mask to the mask support. It may be concluded that, with the above structure, the degradation of color purity caused by dooming can be effectively prevented. However, a test by the present inventors confirmed that such degradation was not prevented, and was actually made worse.

In U.S. Pat. Nos. 3,808,493 and 4,482,426, and West Germany Pat. No. 2,231,101, in order to control mislanding of the electron beams in association with thermal expansion of the shadow mask, color cathode ray tubes with a shadow mask of an 36% Ni-Fe alloy, i.e., an invar steel member, are commercially available. The invar steel member has a thermal expansion coefficient as small as 1/10 of that of the conventional cold-rolled steel plate mainly made of Fe and greatly reduces thermal expansion of the shadow mask. However, when an invar steel member is used in the shadow mask, the mask frame is preferably also constituted by an invar steel member, in order to prevent a conventional drawback (e.g., thermal deformation of the shadow mask) caused by a difference between thermal expansion coefficients of the shadow mask and the mask frame during heat treatment. In practice, since the Ni alloy for invar steel members is expensive, characteristics of the color cathode ray tube are improved by the use of an invar steel member as a shadow mask while a cold-rolled steel plate mainly made of Fe is used as the mask frame, in order to minimize an increase in total cost of the color cathode ray tube. In a color cathode ray tube using such an invar steel member, however, the degradation of color purity cannot be sufficiently prevented (to be described in detail later).

SUMMARY OF THE INVENTION

It is, therefore, an object of the present invention to provide a color cathode ray tube wherein degradation of color purity is reduced by decreasing mislanding of electron beams during a long period of time. According to the invention, there is provided a color cathode ray tube comprising a vacuum envelope with an axis and including a panel section, a funnel section and a neck section, said panel section being composed of a faceplate, a front view shape of which is substantially rectangular and which has an inner surface, and a skirt with a peripheral inner surface extending from a peripheral edge of said faceplate, said funnel section being contiguous to said skirt of said panel section, and said neck section being contiguous to said funnel section, a phosphor screen formed on said inner surface of said faceplate, an electron gun assembly, arranged in said neck section, for emitting electron beams to be landed on said phosphor screen, a shadow mask arranged in said panel section to oppose said phosphor screen and having a large number of apertures for allowing passage of electron beams therethrough, said shadow mask being made of a metal with a thermal expansion coefficient $\alpha m$, a mask frame for suspending and supporting said shadow mask, said mask frame being made of a metal with a thermal expansion coefficient $\alpha f$, and members for supporting said mask frame on said peripheral inner surface of said skirt, each of said members being provided with a straight plate section with a predetermined angle $\alpha$ defined by the following inequality and first and second base sections extending from both ends of said straight plate section and fixed on said mask frame and said inner surface of said skirt, respectively, said support members being elastically deformable when said shadow mask and said mask frame are thermally expanded, $$\tan(\alpha) > (\alpha m/\alpha f)\tan(90-\beta)$$

where $\beta$ is an angle formed by a tube axis and one of the electron beams which passes through effective one of said apertures, said effective one of said apertures being closest to said support member and located at an outermost position of said shadow mask.

DETAILED DESCRIPTION OF THE PREFERRED EMBODIMENT

Figure 1:
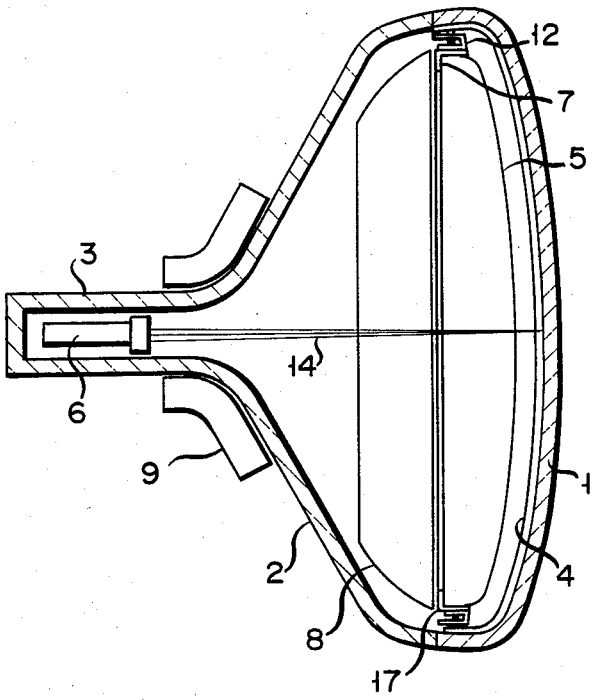
FIG. 1 (PRIOR ART)
FIG. 1 is a schematic sectional view of a conventional color cathode ray tube.

A color cathode ray tube according to an embodiment of the present invention is substantially the same as a conventional color cathode ray tube, except that a shadow mask is supported by a resilient support member 22 on an inner surface of a side wall, i.e., a skirt of the panel. The basic structure of the color cathode ray tube of this invention will not be described and the description of the conventional color cathode ray tube in FIG. 1 can be referred to.

Figure 4:
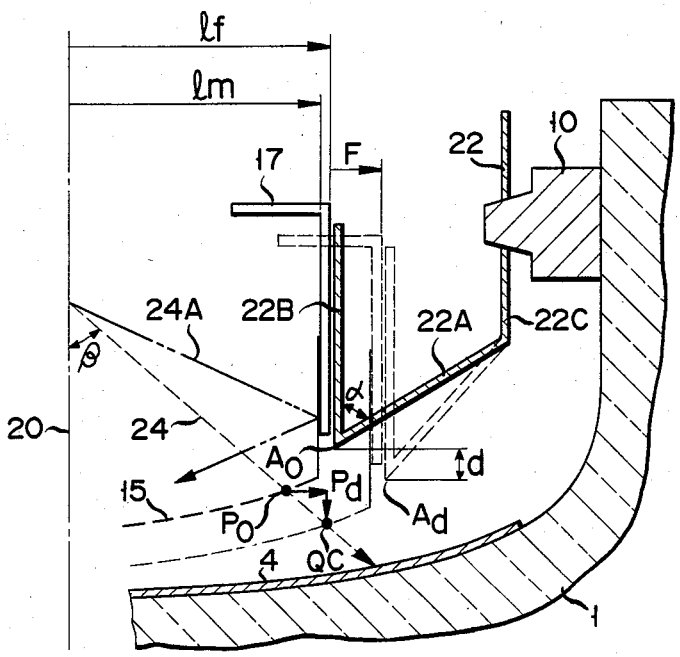
FIG. 4 is a sectional view showing part of a color cathode ray tube with a structure wherein a shadow mask is supported on the inner surface of the panel according to an embodiment of the present invention.
Figure 5:
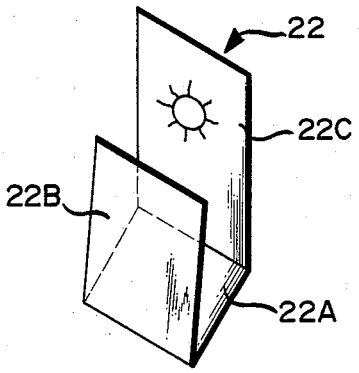
FIG. 5 is a perspective view of a support member shown in FIG. 4.

FIG. 4 shows a structure of the color cathode ray tube of the preferred embodiment, wherein the shadow mask is supported by the support member 22 on the inner side wall, i.e., a skirt of the panel. In the color cathode ray tube shown in FIG. 4, phosphor screen 4, consisting of phosphor stripes for emitting red, green, and blue light rays upon landing of electron beams thereon, is formed on the inner surface of the faceplate of substantially rectangular panel 1. Shadow mask 15 is arranged opposite to screen 4. Mask 15 has a large number of slit apertures aligned in the vertical direction and a large number of vertical arrays alinged in the horizontal direction. Mask 15 comprises a 0.2-mm thick cold-rolled steel plate mainly made of Fe with a thermal expansion coefficient $\alpha m$ of about $1.2\times10^{-5}\,deg^{-1}$ in a range between room temperature and 200° C. The side wall of mask 15 is fixed to a mask frame 17 which comprises a 1.6-mm thick mask frame cold-rolled steel plate mainly made of Fe 17 with a thermal expansion coefficient $\alpha f$ of about $1.2\times10^{-5}\,deg^{-1}$ in a range between room temperature and 200° C. Stud pin 10 extends on the inner wall surface, i.e., an inner surface of the skirt of frame 17 and panel 1. Pin 10 has a hollow structure having a 0.5 mm thickness and made of 18% Cr-Fe alloy. Resilient support member 22 (FIG. 5), obtained by bending a 0.4 mm spring metal plate, for example precipitation hardening type SUS 631, is fixed between frame 17 and pin 10. Tongue sections 22B and 22C of the member 22 are substantially parallel to axis 20 of the cathode ray tube and parallel to each other, and inclined bridge section 22A of the member 22 is contiguous with sections 22B and 22C. At room temperature, i.e., when member 22 is not heated, angle $\alpha$ between section 22A of member 22 and axis 20 satisfies condition (1):

$$\tan(\alpha) > (\alpha m/\alpha f)\tan(90-\beta) \quad (1)$$

where $\beta$ is the angle between axis 20 and one of the electron beams which passes through a given slit aperture closest to member 22 at the outermost portion of mask 15.

In condition (1), angle $\beta$ slightly varies in accordance with a reference electron beam since three electron beams pass through the given slit aperture. Differences of angles of each electron beam incident on each aperture fall within the allowable range and are negligible.

In the above embodiment, mask 15 may be formed integrally with frame 17. Member 22 is preferably located at the corner of panel 1 so as to maintain a relatively high mechanical strength.

Correction of thermal expansion of shadow mask (15) by member 22 will now be described in detail.

Angle $\alpha$ formed between axis 20 and member 22A of member 22 is set to be, for example, about 57° when the color cathode ray tube is a 90° deflection tube and members 22 are located at four corners of rectaugular panel 1. When frame 17 is thermally expanded, thin member 22 is deformed by this thermal expansion, as indicated by the broken line in FIG. 4. Vertex Ao of member 22 is moved (Ao→Ad) toward screen 4 because of its configuration. Frame 18 and mask 15, fixed to member 22, are moved toward screen 4 in a deformation direction defined by member 22, thereby correcting mislanding.

Figure 6:
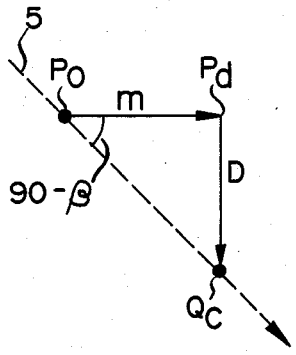
FIG. 6 is a vector diagram schematically showing a deviation of a vertex of the member shown in FIG. 5.

More specifically, mask 15 is thermally expanded by its temperature rise tm and its expansion, i.e., the displacement of the apertures thereof, corresponds to distance m from point P0 to point Pd, as shown in FIGS. 4 and 6. In order to correct the deviations of electron beams in association with the thermal expansion of mask 15, the apertures thereof moved to point Pd are then moved by resilient support member 22 to point Qc. Correction distance D can be represented by the geometric expression:

$$D = m \cdot \tan(90 - \beta) \quad (2)$$
$$= \alpha m \cdot tm \cdot lm \cdot \tan(90 - \beta)$$

where lm is the distance from tube axis 20 to the outer wall surface of shadow mask 15, and tm is the temperature rise of shadow mask 15.

The displacement of the apertures of shadow mask 15 from point Pd to point Qc is caused by displacement d of the vertex of support member 22 from point Ao to point Ad. Correction distance d of the displacement of vertex A is represented by the following geometric expression:

$$d = f \cdot \tan(\alpha) \quad (3)$$
$$= \alpha f \cdot tf \cdot lf \cdot \tan(\alpha)$$

where tf is a change in temperature rise of mask frame 17.

When deviations of the electron beams in association with the thermal expansion of mask 15 are to be corrected, correction distance D required for moving the apertures of the shadow mask from point Pd to point Qc must be equal to the actual correction distance d of member 22. That is, $$D = d \quad (4)$$

Substitutions of equations (2) and (3) into equation (4) yield equation (5) below:

$$\tan(\alpha) = (\alpha m \cdot tm \cdot lm / \alpha f \cdot tf \cdot lf) \tan(90 - \beta) \quad (5)$$

If mask 15 and frame 17 are made of the same material, e.g, a cold-rolled steel plate mainly made of Fe, thermal expansion coefficients $\alpha m$ and $\alpha f$ are equal to each other:

$$\alpha m / \alpha f = 1 \quad (6)$$

Since the thickness of frame 17 is about 1.6 mm, $$lm / lf \approx 1 \quad (7)$$

Substitutions of equations (6) and (7) into equation (5) yield the following equation:

$$\tan(\alpha) = (tm/tf) \tan(90 - \beta) \quad (8)$$

Assume that the formation condition of the frame support described in Japanese Patent Publication No. 58-144 is given such that the temperature rise of mask 15 is the same as that of frame 17. In this case, tm/tf=1. Condition tm/tf=1 is given for equation (8) to derive the following equation:

$$\alpha = 90 - \beta \quad (9)$$

In the 90° deflection color cathode ray tube wherein the temperature rise of mask 15 is the same as that of frame 17, angle $\beta = 45°$, and angle $\alpha$ is 45°. In other words, angle $\alpha$ is half of the deflection angle.

Figure 2:
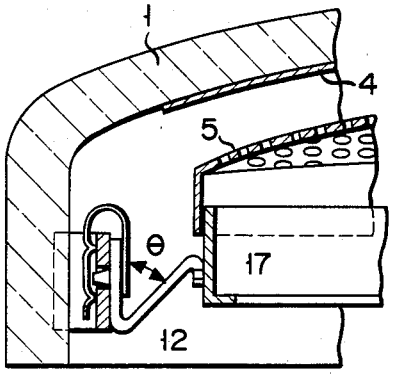
FIG. 2 (PRIOR ART)
FIGS. 2 and 3 are sectional views showing parts of other conventional color cathode ray tubes with structures wherein shadow masks are supported on the inner surfaces of the panels.

In consideration of the condition for equation (8), when the V-shaped frame support (FIG. 2) with an angle (Japanese Patent Publication No. 58-144) half of the deflection angle is used, mislanding of the electron beams in association with the thermal expansion of mask 15 is expected to be corrected. However, during actual operation of this color cathode ray tube, the shadow mask temperature varied greatly from the temperature of the mask frame, and it was concluded that the deviations in electron beams in association with the thermal expansion of the shadow mask could not be sufficiently corrected by the known technique disclosed therein.

Figure 7:
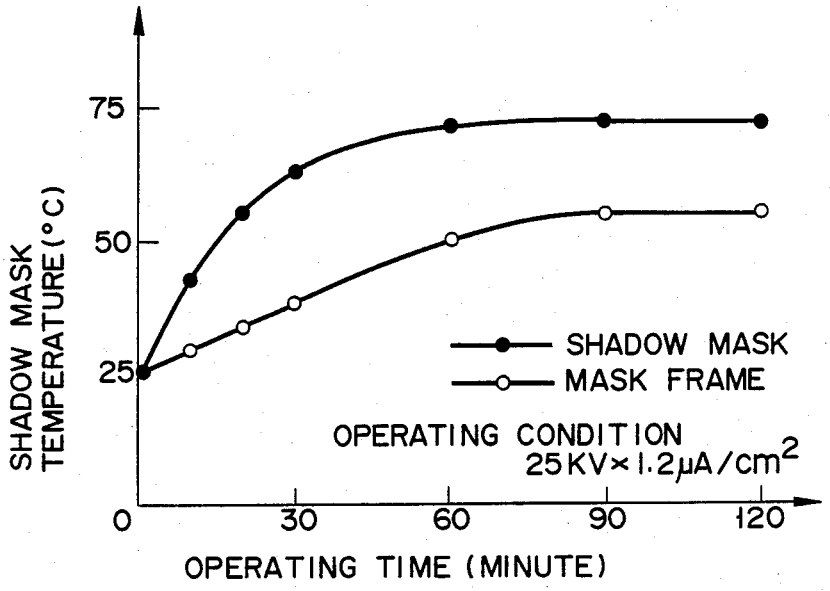
FIG. 7 is a graph showing temperature changes in the shadow mask and the mask frame during the operation of a color cathode ray tube as a function of time.

The present inventors conducted a test using a 21" color cathode ray tube with the structure of the embodiment described above to obtain test results representing temperature changes in shadow mask 15 and mask frame 17, as shown in the graph of FIG. 7. As is apparent from FIG. 7, shadow mask 15 was heated to a temperature of about 47° C. during operation of the tube, while mask frame 17 was heated to a temperature of about 30° C. Correction angle $\alpha$ of resilient support member 22 (FIG. 4), for correcting mislanding of electron beams in association with the thermal expansion of shadow mask 15, was calculated according to equation (8) as follows:

$$\alpha = \tan^{-1}(47/30)\tan(90 - 45) \quad (10)$$
$$= 57$$

It is thus apparent that member 22 with an angle half of the deflection angle cannot correct mislanding of electron beams.

The temperature of mask frame 17 is lower than that of shadow mask 15 for the following reason. In a normal television receiver, a shortage of a scanning area is caused by variations in deflection angle in association with changes in high voltages in the television set. In other words, lack of a reproduced image on the screen occurs. In order to prevent this, the deflection angle of the electron beams is set to be larger than the rated angle. However, when the deflection angle is excessively increased, deflection power is increased, with resultant energy loss. In addition, electron beams 24A reflected by the side wall of mask 15 or frame 17 in FIG. 4 bombard the phosphor stripes of screen 4, thus greatly degrading the color purity. An increase in deflection angle to prevent lack of a reproduced image on the screen is normally limited to a range of ±3%. During the operation of this color cathode ray tube, the electron beams always bombard mask 15 and its peripheral portion to increase its temperature. However, electron beams directly bombarding frame 17 are few. Thus, the temperature rise in frame 17 is confined to conduction (including heat radiation) from high-temperature mask 15. Therefore, in a conventional color cathode ray tube, the temperature of frame 17 is always held to be lower than that of mask 15.

Figure 8:
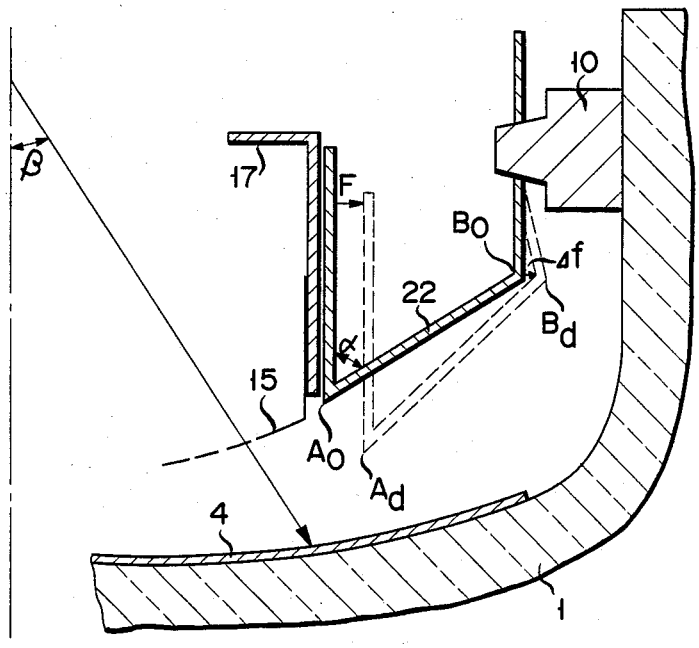
FIG. 8 is a schematic sectional view of the support member shown in FIG. 4 for explaining elastic deformation of the support member.

As shown in FIG. 8, when displacement F in association with the thermal expansion of frame 17 occurs, member 22 is deformed in any shape and ideal correction cannot be performed. For example, when displacement F occurs, vertex B0 of member 22 is deformed by Δf in the same direction of the thermal expansion of frame 17 and a deformation force supposed to move vertex Ao of member 22 to position Ad is cancelled. At worst, mislanding is increased.

It is thus apparent that even if the angle of the frame support described in Japanese Patent Publication No. 58-144 is set to be half of the deflection angle, mislanding of the electron beams cannot be sufficiently corrected.

Figure 3:
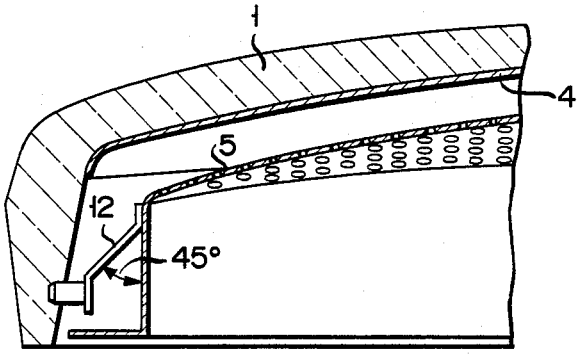
FIG. 3 (PRIOR ART)

As previously described, Japanese Patent Publication No. 46-4104 describes a color cathode ray tube (FIG. 3) wherein mask 5 is mounted to member 12 without using a mask frame, and the correction angle is set substantially half of the deflection angle to correct landing of the electron beams. In this color cathode ray tube, since a mask frame is not used, the thermal expansion of shadow mask 5 is directly applied to resilient support member 12. When the deflection angle was set to be 90°, required correction distance D represented by equation (2) is substantially the same as actual correction distance d of member 12, which is represented by equation (3). However, when a deflection angle is set to be 110°, as in most large color cathode ray tubes, angle α of resilient support member 12 is 55°, or half of the deflection angle. Required correction distance D and correction distance d of member 12 are given by equations (11) and (12), derived from equations (2) and (3):

$$D=\alpha m\cdot tm\cdot lm\cdot\tan(90-55) \quad (11)$$

$$d=\alpha f\cdot tf\cdot lf\cdot\tan(55) \quad (12)$$

for $\beta=\alpha=55°$

Since a mask frame is not used and the relationship between required correction distance D and correction distance d is given as $\alpha f\cdot tf\cdot lf/\alpha m\cdot tm\cdot lm=1$:

$$d/D = \alpha f\cdot tf\cdot lf\cdot\tan(55)/\alpha m\cdot tm\cdot lm\cdot\tan(90-55) \quad (13)$$
$$= 2$$

In the technique disclosed in Japanese Patent Publication No. 46-4104, the difference between distances D and d was increased. More specifically, distance d was about twice distance D. Mislanding of the electron beams could not be corrected, but were increased, thus degrading the color purity. In this manner, the prior art was found to be as a particular application.

The present inventors made a test using 21", 90° deflection and 28", 110° deflection color cathode ray tubes. Test results will be described in detail with reference to FIG. 9. Time is plotted along the abscissa, and the mislanding amounts of the electron beams are plotted along the ordinate. Mislanding of the electron beams was measured at a point on a diagonal axis 330 mm removed from the center of the screen when the cathode ray tubes were operated with a white screen at a voltage of 25 kV and a beam current density of 1.2 μA/cm². A horizontal direction removed from the center of the phosphor screen was defined as a positive direction, and the opposite direction was defined as a negative direction.

Figure 9:
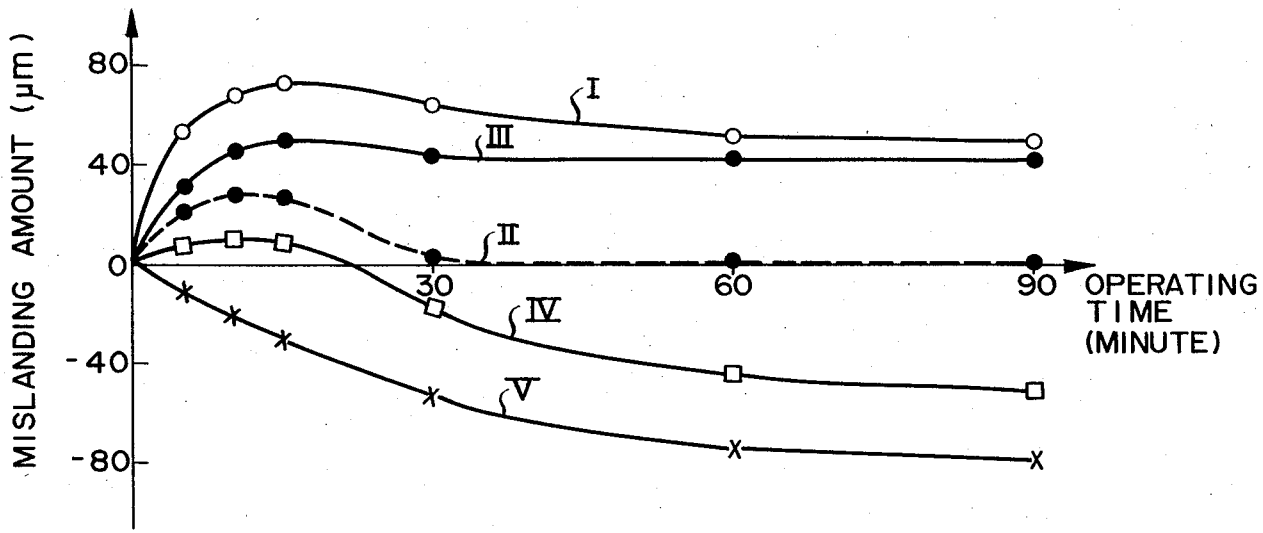
FIG. 9 is a graph showing mislanding distances of the color cathode tube in FIG. 4 as a function of time, as compared with the conventional color cathode ray tube.

In FIG. 9, characteristic curve I represents changes in the conventional 21", 90° deflection color cathode ray tube wherein a mask frame is locked to substantially the central side walls of respective sides of the rectangular panel through a bimetal member. Characteristic curve II shows data obtained using a 21", 90° deflection cathode ray tube according to the present invention. In other words, curve II shows data of a cathode ray tube wherein mask 15 supported by frame 17 is locked by members 22 on the four corners of the inner surface of rectangular panel 1. In this tube, angle α between axis 20 and inclined bridge section 22A of member 22 was set to be 57° in consideration of the temperature difference (represented by equation (10)) between mask frame 17 and shadow mask 15 during operation, and flexure Δf (FIG. 8) of member 22.

As is apparent from FIG. 9, in curve II, a change in mislanding as a function of time is greatly decreased when compared with conventional curve I. Even if dooming occurs, the electron beams can land correctly throughout the operating time, thus preventing the degradation of color purity. However, characteristic curve III of FIG. 9 shows a case wherein the same 21", 90° deflection color cathode ray tube as in curve II was used, angle α between tube axis and the inclinded bridge section 22A of member 22 was set to be 45°, or half of the deflection angle in the same manner as in Japanese Patent Publication No. 58-144, without considering a temperature difference between mask frame 17 and mask 15 during operation. Since the landing-error correction effect of frame support member 22 was small, a mislanding error of about 40 μm occurred 90 minutes after starting operation.

Characteristic curve IV shows changes in mislanding as a function time in a 28", 110° deflection cathode ray tube in which angle α of the mask support is half of the deflection angle, i.e., 55° (half of the deflection angle of 110°), in the same manner as in Japanese Patent Publication Nos. 58-144 and 46-4104. As can be clearly seen, a mislanding error was increased to 50 μm or more, 90 minutes after starting operation. As is apparent from the above descriptions, when angle α of the resilient support member is set to be half of the deflection angle without considering the temperature difference between the mask frame and the shadow mask, high color purity cannot be maintained for a long period of time.

In the 21", 90° deflection color cathode ray tube wherein shadow mask 15 and mask frame 17 were made of the same material, angle α of the support member was found to ideally be 57° according to the above test results. A similar consideration was applied to the 28", 110° deflection color cathode ray tube wherein shadow mask 15 and mask frame 17 were made of the same material, and angle α was found to ideally be 47°. In both these cases, substantially the same data indicated by curve II in FIG. 9 was obtained in the same test described above.

Characteristic curve V shows a mislanding error as a function time in a 28", 110° deflection cathode ray tube wherein mask frame 17 of the same cold-rolled steel plate mainly made of Fe as in the color cathode ray tubes for curves I to IV of FIG. 9 and shadow mask 15 of an invar were used, and angle α of the resilient support member was half, i.e., 55°, of the deflection angle in the same manner as in the prior art Japanese Patent Publication Nos. 58-144 and 46-4104. The mislanding error represented by curve V was shown to be as large as 80 μm or more 90 minutes after starting operation. Therefore, even if shadow mask 15 with a low thermal expansion coefficient is used, characteristics represented by curve V are poorer than those by a conventional shadow mask (curve IV). This is because mask frame 17 of a cold-rolled steel plate mainly made of Fe was greatly expanded while shadow mask 15 of the invar was only slightly expanded. The correction effect of the frame support in response to the thermal expansion of the mask frame was therefore excessively increased. As a result, the mislanding error was not decreased but increased.

The principle of the present invention was applied to a color cathode ray tube wherein a shadow mask made of an invar and a mask frame made of a cold-rolled steel plate mainly made of Fe were used, and angles $\alpha$ were the ideal 45° in the 21", 90° deflection cahtode ray tube and 40° in the 28", 110° deflection cathode ray tube, thus obtaining curve II shown in FIG. 9.

As is apparent from the test results in FIG. 9, conventional techniques can be applied to special color cathode ray tubes wherein angle $\alpha$ of the resilient support member is set to be half of the deflection angle, but cannot be applied to normal color cathode ray tubes. When such techniques are applied to the normal color cathode ray tubes, mislanding errors cannot be decreased but are increased, thus presenting new problems.

However, according to the present invention, mislanding of the electron beams, in association with the thermal expansion of a shadow mask fixed to a mask frame through a support member with an inclined bridge section so as to provide angle $\alpha$ between the tube axis and the support member, can be set in consideration of the temperature difference between the mask frame and the shadow mask such that:

$$\tan(\alpha) > (\alpha m/\alpha f)\tan(90-\beta) \quad (14)$$

An electron beam 24 scanning area is minimized in a normal color cathode ray tube to decrease the deflection power. Electron beams therefore do not substantially bombard the mask frame supporting the peripheral portion of the shadow mask. Ratio tm/tf of the temperature rise tm of the shadow mask to temperature rise tf of the mask frame is substantially 1.57, even if the temperatures of the mask frame and the shadow mask vary in accordance with the type of color cathode ray tube. When a support member is designed according to the present invention, a good mislanding-reduction effect can be obtained in normal color cathode ray tubes when angle $\alpha$ is determined by equation (15):

$$\tan(\alpha) = 1.6 \times (\alpha m/\alpha f) \times \tan(90-\beta) \quad (15)$$

Furthermore, if the shadow mask and the mask frame are made of the same material, the support member can be easily designed since $\alpha m/\alpha f = 1$, giving:

$$\tan(\alpha) = 1.6\tan(90-\beta) \quad (16)$$

As described in the embodiment of the present invention, when the shadow mask is suspended at four corners of the rectangular panel, the rigidity of the mask frame as a support frame is increased, and the mask frame can therefore be made thin, when compared with a conventional mask frame. For example, if the thickness of the mask frame is set to be 0.5 mm, the weight of a 21" color cathode ray tube can be decreased to about 70% that of a tube containing a 1.6-mm thick mask frame. The weight of the conventional 1.6-mm thick mask frame is about 1.6 kg, and the weight of the 0.5-mm thick mask frame is decreased to about 0.5 kg. This light weight also reduces mislanding of the electron beams when impact accidentally acts on the color cathode ray tube.

The present invention is exemplified by the color cathode tube wherein the shadow mask is suspended at four corners of the rectangular panel. However, the present invention is not limited to this. For example, the present invention can also be applied to a structure wherein the shadow mask is suspended at substantially a center portion of the long and short sides of the rectangular panel, and to a structure wherein the shadow mask is suspended through resilient support members each of which have a bridge section inclined at angle $\alpha$ to the tube axis and is engaged with stud pin, to achieve the same effect as in the above embodiment.

As is apparent from the previous descriptions, the simple structure provided by the present invention can greatly decrease mislanding for a long period of time after an initial operation period, effectively preventing color purity degradation such as color misregistration or irregular color distribution, thereby providing color cathode ray tubes suitable for mass production.

What is claimed is:

1. A color cathode ray tube comprising:

a vacuum envelope with an axis and including a panel section, a funnel section and a neck section, said panel section being composed of a faceplate, a front view shape of which is substantially rectangular and which has an inner surface, and a skirt with a peripheral inner surface extending from a peripheral edge of said faceplate, said funnel section being contiguous to said skirt of said panel section, and said neck section being contiguous of said funnel section;

a phosphor screen formed on said inner surface of said faceplate;

an electron gun assembly, arranged in said neck section, for emitting electron beams to be landed on said phosphor screen;

a shadow mask arranged in said panel section to oppose said phosphor screen and having a large number of apertures for allowing passage of electron beams therethrough, said shadow mask being made of a metal with a thermal expansion coefficient $\alpha m$;

a mask frame for suspending and supporting said shadow mask, said mask frame being made of a metal with a thermal expansion coefficient $\alpha f$; and members for supporting said mask frame on said peripheral inner surface of said skirt, each of said members being provided with a straight plate section with a predetermined angle $\alpha$ defined by the following inequality and first and second base sections extending from both ends of said straight plate section and coupled to said mask frame and said inner surface of said skirt, respectively, said support members being elastically deformable when said shadow mask and said mask frame are thermally expanded, $$\tan(\alpha) > (\alpha m/\alpha f)\tan(90-\beta)$$

where $\beta$ is an angle formed by the tube axis and one of the electron beams which passes through effective one of said apertures, said effective one of said apertures being closest to said support member and located at an outermost position of said shadow mask.

2. A tube according to claim 1, wherein said mask frame and said shadow mask are made of the same material.

3. A tube according to claim 2, wherein said mask frame and said shadow mask are made of a cold-rolled steel plate mainly composed of Fe.

4. A tube according to claim 3, wherein said mask frame has four corners, and said first base sections of said supporting members are coupled to said mask frame at said four corners.

5. A tube according to claim 4, wherein said color cathode ray tube is a 21", 90° deflection type tube, and said predetermined angle $\alpha$ is substantially 57°.

6. A tube according to claim 4, wherein said color cathode ray tube is a 28", 110° deflection type tube, and said predetermined angle $\alpha$ is substantially 47°.

7. A tube according to claim 1, wherein said mask frame and said shadow mask are made of different materials.

8. A tube according to claim 7, wherein said shadow maks is made of invar, and said mask frame is made of a rolled steel plate mainly composed of Fe.

9. A tube according to claim 8, wherein said mask frame has four corners, and said first base sections of said supporting members are coupled to said mask frame at said four corners.

10. A tube according to claim 9, wherein said color cathode ray tube is a 21", 90° deflection type tube, and said predetermined angle $\alpha$ is substantially 45°.

11. A tube according to claim 9, wherein said color cathode ray tube is a 28", 110° deflection type tube, and said predetermined angle $\alpha$ is substantially 40°.

12. A tube according to claim 1, wherein said first base sections of said supporting members have a plate-like shape, and said straight plate section and said first base sections define a V-shaped structure.

13. A tube according to claim 1, wherein said second base sections of said supporting members are coupled to said peripheral inner surface of said skirt through stud pins.

14. A tube according to claim 1, wherein said supporting member is formed by bending a metal plate.

15. A tube according to claim 1, wherein said shadow mask is integrally formed with said mask frame.

* * * * *